US010283828B2

(12) United States Patent
Cooper et al.

(10) Patent No.: US 10,283,828 B2
(45) Date of Patent: May 7, 2019

(54) TUNING TRIPLE-MODE FILTER FROM EXTERIOR FACES

(71) Applicant: Nokia Solutions and Networks Oy, Espoo (FI)

(72) Inventors: Steven Cooper, Moorooka (AU); Kimmo Kalervo Karhu, Oulu (FI); David Hendry, Auchenflower (AU); Kimmo Siponen, Kempele (FI); Mostafa Shabani, West Mackay (AU)

(73) Assignee: Nokia Solutions and Networks Oy, Espoo (FI)

( * ) Notice: Subject to any disclaimer, the term of this patent is extended or adjusted under 35 U.S.C. 154(b) by 172 days.

(21) Appl. No.: 15/421,775

(22) Filed: Feb. 1, 2017

(65) Prior Publication Data

US 2018/0219268 A1 Aug. 2, 2018

(51) Int. Cl.
*H01P 1/20* (2006.01)
*H01P 7/10* (2006.01)

(52) U.S. Cl.
CPC ..... *H01P 1/2002* (2013.01); *H01P 7/10* (2013.01); *H01P 7/105* (2013.01)

(58) Field of Classification Search
CPC ..... H01P 1/2002; H01P 7/10; H01P 7/015
USPC ..... 333/209, 219.1, 219
See application file for complete search history.

(56) References Cited

U.S. PATENT DOCUMENTS 3,657,670 A 4/1972 Kitazume et al. ..... 333/73 W
4,879,533 A 11/1989 de Muro et al. ..... 333/206
4,963,844 A 10/1990 Konishi et al. ..... 333/208
5,023,866 A 6/1991 De Muro ..... 370/24
5,307,036 A 4/1994 Turunen et al. ..... 333/202
(Continued)

FOREIGN PATENT DOCUMENTS

JP 2002135003 A 5/2002

OTHER PUBLICATIONS

Dupont, "Properties Handbook", Dupont, p. 4 (30 pgs.), Nov. 2003.

*Primary Examiner* — Rakesh B Patel
(74) *Attorney, Agent, or Firm* — Harrington & Smith

(57) ABSTRACT

A first dielectric resonator component is joined to a second dielectric resonator component by bonding a first face of the first dielectric resonator component to a second face of the second dielectric resonator component. The first face has a first coupling aperture formed by removing a portion of a coating of first conductive material from the first dielectric resonator component, and the second face has a second coupling aperture formed by removing a portion of a coating of second conductive material from the second dielectric resonator component. The first coupling aperture and said second coupling aperture are aligned with one another when said first face is bonded to the second face. The first dielectric resonator component, which is slab-shaped, and the second dielectric resonator component, which is generally cubed-shaped, form a linear stack having two end faces and four side faces. A first hole is provided at a point along a center line of a side face of the first dielectric resonator component in the direction of orientation of the linear stack, and a second hole is provided substantially in the center of a side face of the second dielectric resonator component to tune a resonant frequency of the pair of joined dielectric resonator components.

20 Claims, 7 Drawing Sheets

(56) References Cited

U.S. PATENT DOCUMENTS

| | | | | |
|---|---|---|---|---|
| 5,325,077 | A | 6/1994 | Ishikawa et al. | 333/219.1 |
| 5,568,101 | A * | 10/1996 | Konishi | H01P 1/2136 333/134 |
| 6,002,306 | A * | 12/1999 | Arakawa | H01P 1/2138 333/134 |
| 6,016,091 | A | 1/2000 | Hidaka et al. | 333/202 |
| 6,025,291 | A | 2/2000 | Murakawa | 501/136 |
| 6,133,808 | A | 10/2000 | Arakawa | 333/134 |
| 6,160,463 | A | 12/2000 | Arakawa et al. | 333/202 |
| 6,346,867 | B2 | 2/2002 | Arakawa et al. | 333/208 |
| 6,549,094 | B2 | 4/2003 | Takagi et al. | 333/134 |
| 6,677,837 | B2 | 1/2004 | Kojima et al. | 333/208 |
| 6,762,658 | B1 | 7/2004 | Isomura et al. | 333/202 |
| 6,825,740 | B2 | 11/2004 | Kundu | 333/202 |
| 7,042,314 | B2 | 5/2006 | Wang et al. | 333/202 |
| 8,325,077 | B2 | 12/2012 | Gentric | 341/173 |
| 2001/0000429 | A1 | 4/2001 | Arakawa et al. | 333/208 |
| 2001/0024147 | A1 | 9/2001 | Arakawa et al. | 333/135 |
| 2002/0024410 | A1 | 2/2002 | Guglielmi et al. | 333/202 |
| 2002/0039058 | A1 | 4/2002 | Sano et al. | 333/202 |
| 2003/0006864 | A1 | 1/2003 | Hattori et al. | 333/202 |
| 2003/0090343 | A1* | 5/2003 | Wilber | H01P 1/2086 333/202 |
| 2003/0090344 | A1 | 5/2003 | Wang et al. | 333/202 |
| 2003/0227360 | A1 | 12/2003 | Kirihara et al. | 333/239 |
| 2004/0056736 | A1 | 3/2004 | Enokihara et al. | 333/202 |
| 2005/0128031 | A1 | 6/2005 | Wilber et al. | 333/202 |
| 2005/0140474 | A1 | 6/2005 | Kim et al. | 333/219.1 |
| 2005/0253672 | A1 | 11/2005 | Enokihara et al. | 333/219.1 |
| 2006/0139127 | A1 | 6/2006 | Wada et al. | 333/202 |
| 2008/0018391 | A1 | 1/2008 | Bates | 327/557 |
| 2008/0211601 | A1 | 9/2008 | Bates | 333/186 |
| 2014/0077900 | A1 | 3/2014 | Rogozine et al. | 333/212 |

* cited by examiner

TUNING TRIPLE-MODE FILTER FROM EXTERIOR FACES

TECHNICAL FIELD

This invention relates generally to filter components and, more specifically, relates to the tuning of dielectric triple-mode filters.

BACKGROUND

This section is intended to provide a background or context for the invention to be disclosed below. The description to follow may include concepts that could be pursued, but have not necessarily been previously conceived, implemented or described. Therefore, unless otherwise explicitly indicated below, what is described in this section is not prior art to the description in this application and is not admitted to be prior art by inclusion in this section.

In general, a dielectric filter is composed of a number of resonating structures and energy coupling structures which are arranged to exchange radio-frequency (RF) energy among themselves and input and output ports. The pattern of interconnection of these resonators to one another and to the input and output ports, the strength of these interconnections, and the resonant frequencies of the resonators determine the response of the filter.

During the design process for a dielectric filter, the arrangement of the parts, the materials from which the parts are made, and the precise dimensions of the parts are determined such that an ideal filter so composed will perform the desired filtering function. If a physical filter conforming exactly to this design could be manufactured, the filter would perform exactly as intended by the designer.

However, in practice, the precision and accuracy of manufacture of both the materials and the parts are limited, resulting in departures in the values of resonant frequencies and coupling strengths from desired values, These departures, in turn, cause the response of the dielectric filter to differ from that predicted by an ideal filter model. Often, the departures from an ideal response are sufficiently large to bring the filter outside of its design specification. Because of this, it is desirable to make use of some means for adjusting the resonator frequencies and coupling strengths to bring the filter response within the design specification.

This is particularly the case for a class of dielectric filters in which TE (transverse electric) single-mode and triple-mode ceramic-filled cavities are combined. Filters of this type are tuned by making modifications to multiple faces of the components, including faces which will be bonded together in the assembled filter. However, this prevents full tuning of a filter subsequent to bonding, because, at that time, the bonded faces are no longer accessible.

As is recognized by those of ordinary skill in the art, triple-mode cuboid resonators can be tuned by lapping controlled amounts of material from three mutually orthogonal faces of the cuboid, and subsequently resilvering those faces. This allows the frequencies of all three modes of a triple-mode cuboid resonator to be independently adjusted. Single mode slab-shaped cuboid resonators can be tuned by lapping controlled amounts of material off one or more of the narrow faces, subsequently resilvering those faces.

An alternate method to tune triple-mode cuboid resonators is to drill holes in three mutually orthogonal faces, and then either to silver the walls of the holes or to leave the holes unsilvered. This method also allows independent adjustment of all three mode frequencies. In contrast, a single-mode slab-shaped cuboid resonator can be adjusted by drilling a hole or holes into one or both of the large flat faces.

Another method is to cut slots in the silver on at least two mutually orthogonal faces. This method also allows independent adjustment of all three frequencies. A single-mode slab-shaped cuboid resonator can also be adjusted by cutting one or more slots on one or more of the narrow faces, the slots being oriented parallel to the large faces.

As noted above, however, filter components cannot be tuned after the components have been bonded together, because, after bonding, an insufficient number of faces is accessible. The present invention addresses this deficiency in the prior art.

SUMMARY

This section contains examples of possible implementations and is not meant to be limiting.

In an exemplary embodiment, the present invention is a pair of joined dielectric resonator components of an RF filter. The pair of joined dielectric resonator components comprises a first dielectric resonator component and a second dielectric resonator component.

The first dielectric resonator component includes a first block of dielectric material, the first block of dielectric material having a coating of a first conductive material. The first dielectric resonator component is a slab-shaped cuboid having one dimension with a magnitude less than the substantially equal magnitudes of the other two dimensions.

The second dielectric resonator component includes a second block of dielectric material, the second block of dielectric material having a coating of a second conductive material. The second dielectric resonator component is a generally cube-shaped cuboid with three dimensions of substantially equal magnitude.

The first dielectric resonator component is joined to the second dielectric resonator component by bonding a first face of the first dielectric resonator component, the first face having dimensions of substantially equal magnitude, to a second face of the second dielectric resonator component, so that the dimension of the first dielectric resonator component having a magnitude less than the substantially equal magnitudes of the other two dimensions is perpendicular to the first and second faces.

The first face has a first coupling aperture formed by removing a portion of the coating of first conductive material from the first block of dielectric material, and the second face has a second coupling aperture formed by removing a portion of the coating of second conductive material from the second block of dielectric material. The first coupling aperture and the second coupling aperture are aligned with one another when the first face is bonded to the second face.

The first dielectric resonator component and the second dielectric resonator component thereby form a linear stack having two end faces and four side faces. The linear stack is thereby oriented in a direction in common with the one dimension of the first dielectric resonator component having a magnitude less than substantially equal magnitudes of the other two dimensions.

A first hole is provided at a point along a center line of a side face of the first dielectric resonator component in the direction of orientation of the linear stack, and a second hole is provided substantially in the center of a side face of the second dielectric resonator component to tune a resonant frequency of the pair of joined dielectric resonator components.

DETAILED DESCRIPTION OF THE DRAWINGS

The word "exemplary" as used herein means "serving as an example, instance, or illustration." Any embodiment described herein as "exemplary" is not necessarily to be construed as preferred or advantageous over other embodiments. All of the embodiments described in this Detailed Description are exemplary embodiments provided to enable persons skilled in the art to make or use the invention and not to limit the scope of the invention which is defined by the claims.

In accordance with the present invention, an array of tuning holes drilled into a single face of a cuboid triple-mode dielectric resonator component is sufficient to enable all three lowest-order modes of the resonator component to be independently adjusted.

All of the in-band resonant frequencies of all of the components of a filter composed of a linear stack of cuboid dielectric resonator components, possibly including one or more triple-mode resonator components, can be independently adjusted by drilling an array of tuning holes in one or more of the outer faces of the components. If required in a particular application or use of the filter, all of the holes can be provided on a single side of the linear stack.

Additional holes may be drilled in at least one outer face to enable couplings between the dielectric resonator components to be adjusted, when the couplings are implemented with apertures near one or more of the outer faces of the cuboids.

However, when coupling apertures are provided in the center of the bonded faces, the coupling through a central aperture cannot be adjusted in this manner because the distance between the central aperture and an outer face is too large for a hole in the outer face to have any effect.

As noted above, once the dielectric resonator components of a filter have been bonded together, their planar contact surfaces are no longer accessible, thereby preventing any tuning operations requiring access to those surfaces. The tuning method of the present invention has the advantage that all of the in-band resonant frequencies and all of the couplings resulting from apertures close to the outer edges of the dielectric resonator component can be adjusted, even after the dielectric resonator components of the filter have been bonded together.

Figure 1:
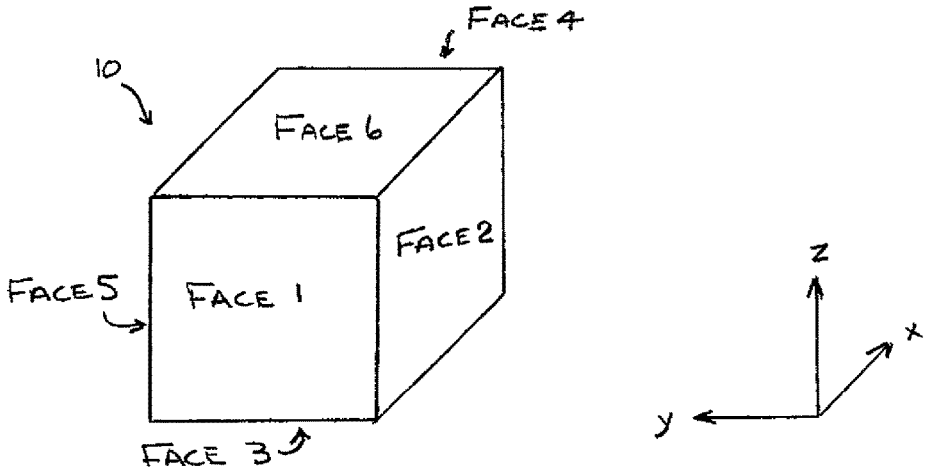
FIG. 1 is a perspective view of a cuboid triple-mode dielectric resonator component.

Turning now to the figures identified above, FIG. 1 is a perspective view of a cuboid triple-mode dielectric resonator component 10 having sides or faces aligned along the X-, Y-, and Z-axes included in the figure. The dielectric resonator component 10 comprises a block of dielectric material having a coating of a conductive material, such as silver. The axis directions and face labels, given to facilitate the discussion to follow, are indicated in FIG. 1.

The three lowest-order resonant modes are commonly referred to as the TE011, TE101, and TE110 modes; the directions of their electric fields are parallel to the X-axis, the Y-axis, and the Z-axis, respectively, TE being the abbreviation for "Transverse Electric". The TE011, TE101, and TE110 modes may alternatively be referred to as the X-mode, the Y-mode, and the Z-mode, respectively.

When the magnitudes of the three dimensions of the dielectric resonator component 10 are close to one another, the resonant frequencies of the three lowest-order resonant modes will also be close to one another. In such a case, the dielectric resonator component 10 may be used as a triple-mode resonator, when the three mode frequencies lie within the passband of the filter. Similarly, when the magnitudes of two of the three dimensions of the dielectric resonator component 10 are close to one another, the frequencies of two of the three lowest-order resonant modes will also be close to one another. Such a dielectric resonator component 10 may be used as a dual-mode resonator. Alternatively, the frequency of the third lowest-order resonant mode may be the in-band frequency, in which case the dielectric resonator component 10 may be used as a single-mode resonator. Finally, when the magnitudes of all three dimensions of the dielectric resonator component 10 are substantially different from one another, all three lowest-order resonant frequencies will be different from one another. When one of these resonant frequencies is in-band, such a dielectric resonator component 10 may also be used as a single-mode resonator. All of the in-band resonant frequencies of the above dielectric resonator components 10 will require careful adjustment to ensure that the completed filter is tuned.

We will consider the case where a cuboid dielectric resonator component 10 is a thin slab-shaped component, wherein the magnitude of one of its three dimensions is significantly smaller than the other two. Further, we will assume that this component has a magnitude such that that the lowest-frequency resonant mode is in-band, so that the cuboid dielectric resonator component 10 may be used as a single-mode resonator. Referring to the face labels in FIG. 1, we will consider the thin dimension of the thin slab-shaped component to be the X-dimension, so that Face 1 and Face 4 will be approximately square-shaped like the faces of a cube, while Faces 2, 3, 5, and 6 will be in the shape of narrow rectangles. The single mode of interest for such a thin slab-shaped component will be the TE011 mode (X-mode). When the thin slab-shaped component is placed in a bonded linear filter stack, only the narrow faces will be accessible, that is, Faces 2, 3, 5, and 6. As a consequence, tuning holes or other structures cannot be placed on Faces 1 and 4 after those faces of the thin slab-shaped component are bonded to those of other dielectric resonator components.

Now we will consider another cuboid dielectric resonator component to have three dimensions of similar magnitude, so that all three lowest-frequency resonant modes are in-band. The three resonant modes of interest are then TE011 (X-mode), TE101 (Y-mode), and TE110 (Z-mode). As with the thin slab-shaped component described above, when the triple-mode cuboid dielectric resonator component is placed in a linear filter stack with Face 1 and Face 4 oriented toward neighboring dielectric resonator components, only Faces 2, 3, 5, and 6 will be accessible. Tuning holes or other structures cannot be placed on Faces 1 or 4 after those faces of the cube-shaped component are bonded to those of other dielectric resonator components.

Figure 2A:
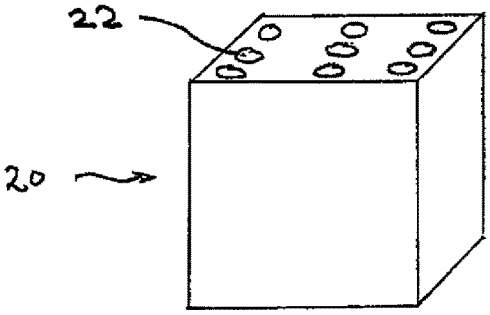
FIG. 2A is a perspective view of a thin slab-shaped dielectric resonator component.
Figure 2B:
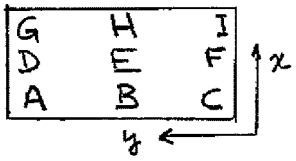
FIG. 2B illustrates the identification scheme for the individual holes in the thin slab-shaped dielectric resonator component shown in FIG. 2A.
Figure 2C:
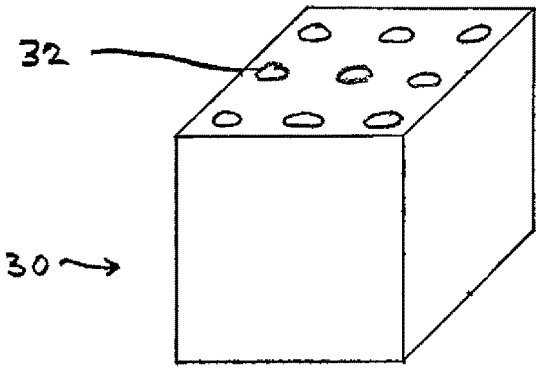
FIG. 2C is a perspective view of an approximately cube-shaped dielectric resonator component.
Figure 2D:
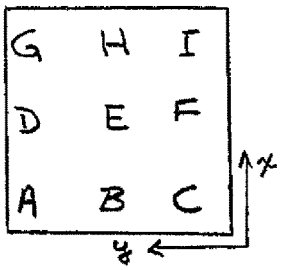
FIG. 2D illustrates the identification scheme for the individual holes in the approximately cube-shaped dielectric resonator component shown in FIG. 2C.

Referring now to FIGS. 2A to 2D, of which FIG. 2A is a perspective view of a thin slab-shaped dielectric resonator component 20, and FIG. 2C is a perspective view of an generally cube-shaped dielectric resonator component 30, a 3×3 array of holes 22, 32 is provided on Face 6, as identified above in connection with FIG. 1, of thin slab-shaped dielectric resonator component 20 and generally cube-shaped dielectric resonator component 30. FIGS. 2B and 2D illustrate the identification scheme for the individual holes 22, 32 in FIGS. 2A and 2C, respectively, used in the following discussion of the calculated shifts in the resonant frequencies of the X-mode, Y-mode, and Z-mode that would result from the provision of the holes.

In the calculations, both the thin slab-shaped dielectric resonator component 20 and the generally cube-shaped dielectric resonator component 30 were assumed to be made from a dielectric material having a dielectric constant of 45. Both the thin slab-shaped dielectric resonator component 20 and the generally cube-shaped dielectric resonator component 30 were also assumed to have a coating of a conductive material, such as silver. The dimensions of the holes 22, 32 were 1.5 mm in diameter and 1.0 mm deep. The dimensions of the generally cube-shaped dielectric resonator component 30 were 17.7 mm×18.0 mm×18.3 mm in the X-, Y-, and Z-directions, respectively, while the dimensions of the slab-shaped dielectric resonator component 20 were 4 mm×18.0 mm×18.3 mm in the X-, Y-, and Z-directions, respectively. The positions of the holes 22, 32 relative to the center of Face 6 are given in the following Table 1:

TABLE 1

| | Cube hole offsets from the center of Face 6 | | Slab hole offsets from the center of Face 6 | |
|---|---|---|---|---|
| Hole | X-offset | Y-offset | X-offset | Y-offset |
| A | −7.0 | −7.0 | −1.0 | −7.0 |
| B | −7.0 | 0.0 | −1.0 | 0.0 |

TABLE 1-continued

| | Cube hole offsets from the center of Face 6 | | Slab hole offsets from the center of Face 6 | |
|---|---|---|---|---|
| Hole | X-offset | Y-offset | X-offset | Y-offset |
| C | −7.0 | 7.0 | −1.0 | 7.0 |
| D | 0.0 | −7.0 | 0.0 | −7.0 |
| E (center) | 0.0 | 0.0 | 0.0 | 0.0 |
| F | 0.0 | 7.0 | 0.0 | 7.0 |
| G | 7.0 | −7.0 | 1.0 | −7.0 |
| H | 7.0 | 0.0 | 1.0 | 0.0 |
| I | 7.0 | 7.0 | 1.0 | 7.0 |

It will be noted, referring to FIGS. 2B and 2D, that the holes adjacent to the corners are identified with A, C, G, and I; those between the corners and adjacent to edges with B, D, F, and H; and that at the center with E.

The calculated shifts in the resonant frequencies of the X-mode, Y-mode, and Z-mode are shown in Table 2 below, for the generally cube-shaped dielectric resonator component 30, and Table 3, for the slab-shaped dielectric resonator component 20, to follow for both filled holes, wherein a coating of a conductive material is provided on the inner surface of the holes 22, 32, and for unfilled holes 22, 32, which are air-filled and capped with a metal cover.

TABLE 2

| | Unfilled holes Freq shift (kHz) | | | Filled holes Freq shift (kHz) | | |
|---|---|---|---|---|---|---|
| Cube Hole | dFx | dFy | dFz | dFx | dFy | dFz |
| A | 1.3 | 1.5 | 17 | 111 | 100 | 109 |
| B | 12 | 1.5 | 147 | *786* | 100 | 209 |
| C | 1.8 | 1.1 | 18 | 111 | 99 | 110 |
| D | 1.4 | 13 | 166 | 110 | *754* | 126 |
| E | 12 | 13 | *1386* | 803 | 796 | *−5816* |
| F | 1.5 | 13 | 166 | 111 | *753* | 109 |
| G | 0.9 | 1.4 | 18 | 110 | 100 | 110 |
| H | 12 | 1.0 | 148 | *788* | 100 | 207 |
| I | 1.3 | 1.5 | 18 | 111 | 100 | 110 |

As may be noted in preceding Table 2, and as indicated by the use of italics, the calculations reveal that the X-mode can be controlled using filled holes 32 at positions B and H, the Y-mode using filled holes 32 at positions D and F, and the Z-mode using unfilled or filled hole 32 at position E. This combination of holes achieves good independent control. Unfilled holes 32 in the corners (A, C, G, and I) have negligible effect on the resonant frequencies of all modes, and, therefore, can be used to control couplings between adjacent dielectric resonator components as will be discussed below. Filled holes 32 in the corners have only a small effect on the resonant frequencies, and may be used to control the couplings between adjacent dielectric resonator components if care is taken to compensate for their effect on the resonant frequencies.

The calculated shifts in the resonant frequencies are for the X-mode in following Table 3 for the slab-shaped dielectric resonator component 20.

TABLE 3

| Slab Hole | Unfilled holes Freq shift (kHz) | Filled holes Freq shift (kHz) |
|---|---|---|
| A | 7.5 | 525 |
| B | 54 | 3843 (X- |

TABLE 3-continued

| Slab Hole | Unfilled holes Freq shift (kHz) | Filled holes Freq shift (kHz) |
|---|---|---|
| | | centerline) |
| C | 7.0 | 528 |
| D | 7.8 | 502 |
| E | 55 | 3660 (Center of Face 6) |
| F | 6.5 | 501 |
| G | 6.7 | 521 |
| H | 53 | 3830 (X-centerline) |
| I | 6.1 | 526 |

Based on the results provided in Table 3, all of the holes 22 increase the resonant frequency of the X-mode, although the holes on the X-centerline (B, E, and H) do so most effectively.

Based on the results of the calculations described above, an effective set of tuning holes 32 to use for a cube-shaped dielectric resonator component 30 is a filled hole 32 at one or both of positions B and H to adjust the X-mode resonant frequency, a filled hole 32 at one or both of positions D and F to adjust the Y-mode resonant frequency, and either a filled or an unfilled hole 32 at position E to adjust the Z-mode resonant frequency. These provide three degrees of freedom which, while not completely independent, are reasonably orthogonal. With the aid of a tuning matrix of the sort disclosed in U.S. patent application Ser. No. 15/227,169, filed Aug. 3, 2016, the teachings of which are incorporated herein by reference, it is straightforward to calculate the hole depths required to achieve a desired set of resonant frequency changes. One method to calculate needed tuning is use coupling matrix extraction from a measured filter s-parameters. A calculated matrix is just compared to a target coupling matrix, and all clear deviations are corrected by a calculated drill tuning. This method is also suitable for coupling tuning.

Since there is only one resonant frequency (X-mode) to adjust in a slab-shaped dielectric resonator component 20, a hole 22 at almost any position (A to I) on one of the narrow faces will cause a resonant frequency shift. However, the most effective positions are on the X-centerline of the face, such as Face 6, as indicated with italics for filled holes at positions B, E, and H in Table 3 above.

As stated at the outset, a class of dielectric filters in which TE (transverse electric) single-mode and triple-mode ceramic-filled cavities are combined is of interest in the present application. This type of filter heretofore could not be fully tuned subsequent to bonding, because, the bonded faces are no longer accessible.

Figure 3A:
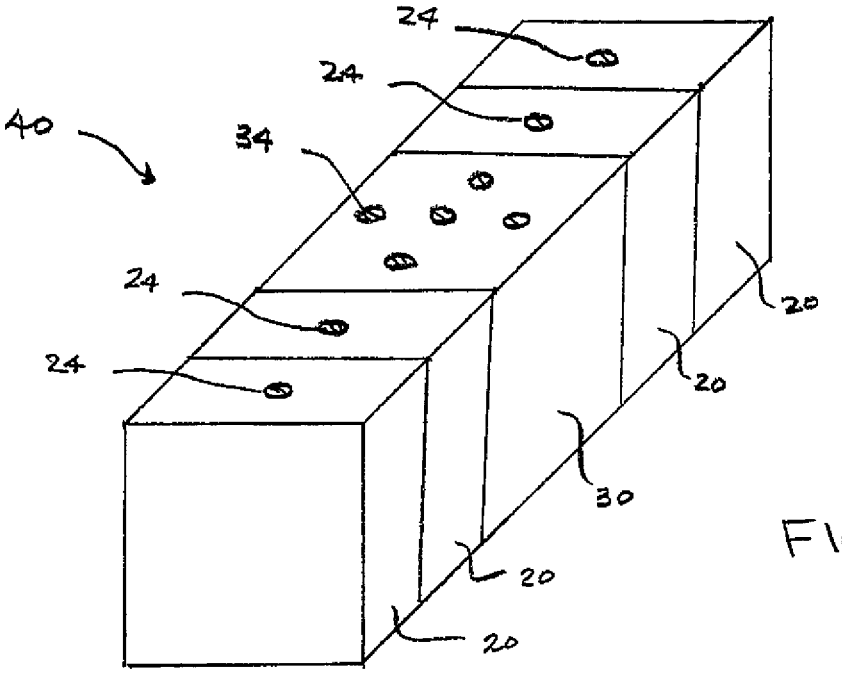
FIG. 3A is a perspective view of an exemplary dielectric filter of the present invention.

However, based on the calculations described above, a set of holes suitable for adjusting the resonant frequencies in a dielectric filter of this type is shown in FIG. 3A. Because all of the holes are located on a single outer side of the dielectric filter, the dielectric filter can be tuned after the components have been bonded together. Having all of the holes on one side greatly eases the tuning process during manufacture because all of the holes are readily accessible without any need to reposition the dielectric filter.

More specifically, FIG. 3A is a perspective view of an exemplary dielectric filter 40 having a central generally cube-shaped dielectric resonator component 30 with two slab-shaped dielectric-resonator components 20 at each end, thereby forming a filter stack. In approximately cube-shaped dielectric resonator component 30, holes 34, filled with a conductive material, are provided at five positions, analogous to positions B, D, E, F, and H in FIG. 2D, as suggested by the calculations summarized in Table 2 above. It should be understood that positions B, D, E, F, and H should not be considered to be exact positions, as they were defined for the calculations described above. Rather, for example, position E is at or near the center, while positions B, D, F, and H are at or near the middle of the edges.

Similarly, in each of the slab-shaped dielectric resonator components 20, a hole 24, filled with a conductive material, is provided at a central position, analogous to position E in FIG. 2B, as suggested by the calculations summarized in Table 3 above. Again, it should be understood that position E should not be considered to be an exact position, as it was defined for the calculations described above. Rather, for example, position E is at or near the center of the face (Face 6).

Figure 3B:
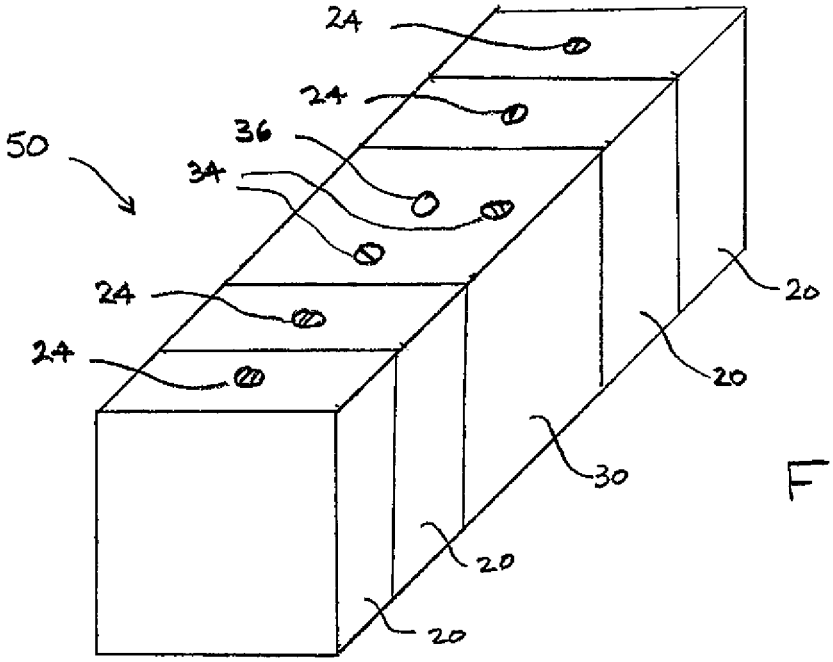
FIG. 3B is a perspective view of an alternate embodiment of the exemplary dielectric filter shown in FIG. 3A.

The holes 24, 34 shown in FIG. 3A may be recognized as being a symmetrical set. An exemplary dielectric filter 50 like that shown in FIG. 3A, but having a minimal set of holes 24, 34, 36 is shown in a perspective view in FIG. 3B.

More specifically, in exemplary dielectric filter 50, approximately cube-shaped dielectric resonator component 30, holes 34, 36, are provided at three positions, analogous to positions B, E, and F in FIG. 2D, again as suggested by the calculations summarized in Table 2 above. Hole 36 at the central position (position B) is unfilled, while the other two holes 34 are filled as above. Unfilled hole 36 provides less of a resonant frequency shift than filled hole 34 at the central position, while the use of one of the two filled holes 34 at positions B and H, and D and F reduces the shift that would be provided by both of the holes in each pair together.

As was the case in FIG. 3A, each of the slab-shaped dielectric resonator components 20 has a hole 24, filled with a conductive material, provided at a central position, analogous to position E in FIG. 2B, as suggested by the calculations summarized in Table 3 above, where unfilled holes are shown to have little effect on the resonant frequency.

In addition to the ability to adjust the resonant frequencies, the set of holes illustrated in FIGS. 2A to 2D also allows the electric-field couplings between dielectric resonator components to be adjusted. However, in order to be able to adjust the strengths of the electric-field coupling in this manner, the aligned coupling apertures on the planar contact surfaces of adjacent dielectric resonator components must be close to a corner of the planar contact surface, as holes provided on an outer surface of a dielectric resonator component are too far away from a coupling aperture located in the center of a planar contact surface to have any effect.

Figure 4A:
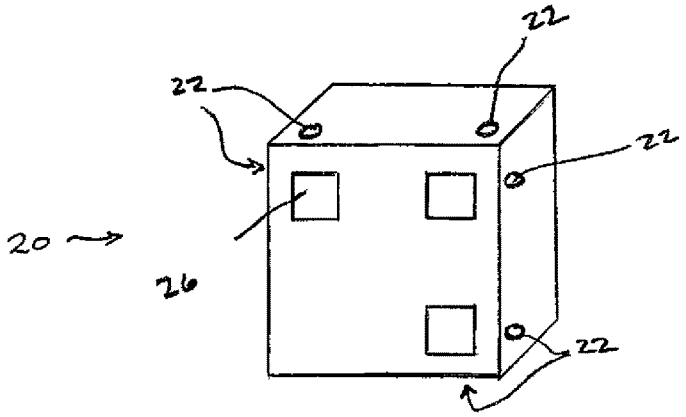
FIG. 4A is a perspective view of a slab-shaped dielectric resonator component with coupling apertures and holes for adjusting electric-field coupling strength.
Figure 4B:
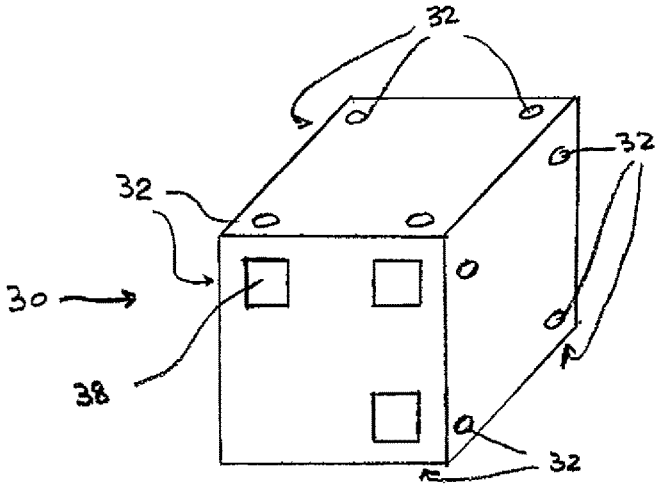
FIG. 4B is a perspective view of an approximately cube-shaped dielectric resonator component with coupling apertures and holes for adjusting electric-field coupling strength.

In this regard, reference is now made to FIGS. 4A and 4B. Referring first to FIG. 4A, a perspective view of a slab-shaped dielectric resonator component 20, coupling apertures 26, which are areas where the coating of conductive material has been removed from the face of the resonator component 20, are provided near the corners of the planar contact surface (Face 1 or Face 4) thereof. Holes 22 provided near the corners, such as at positions A, C, G, and I, for his purpose may be either filled or unfilled. Coupling apertures 26 may be square, as shown, but may also be provided in other shapes, such as circular.

Similarly, referring to FIG. 4B, a perspective view of an generally cube-shaped dielectric resonator component 30, coupling apertures 38, which are areas where the coating of conductive material has been removed from the face of the resonator component 30, are provided near the corners of the planar contact surface (Face 1 or Face 4) thereof. Holes 32 provided near the corners, such as at positions A, C, G, and I, for his purpose may be either filled or unfilled. Coupling apertures 38 may be square, as shown, but may also be provided in other shapes, such as circular.

When coupling apertures 26, 38 are in the corners, holes 22, 32 placed in the corners of the outer faces are very suitable for use as coupling adjustments. Referring to the resonant frequency shifts due to the corner hole positions (A, C, G, and I) in Table 2, for unfilled holes, the resonant frequency shifts are negligible, while, for filled holes, the resonant frequency shifts are significantly smaller than those for the other hole positions. As a result, the disturbance to the resonant frequencies caused by modifications to corner holes are small, and may be compensated by the other holes. Thus, the corner holes may be used to adjust the coupling strengths.

Since every hole changes multiple quantities, both resonant frequencies and electric-field couplings, it will be necessary to use a tuning matrix of the sort disclosed in the above-referenced U.S. patent application Ser. No. 15/227,169 to calculate the depth changes required in all of the holes to achieve the desired changes to all of the resonant frequencies and electric-field couplings. Unlike the situation described in U.S. patent application Ser. No. 15/227,169, where only resonant frequency adjustments are discussed, in the present case the quantities to be adjusted are resonant frequencies and couplings.

The couplings could be adjusted by placing the corner holes either in the slab-shaped dielectric resonator component 20 shown in FIG. 4A or in the approximately cube-shaped dielectric resonator component 30 shown in FIG. 4B. Since the resonant frequency tunings in the cube are more critical than those in the slab, it would be preferable to use corner holes in the slab to adjust the couplings because any resulting frequency errors would be less serious.

Even though a nine-hole embodiment has been shown, the essential methods described would also work with other arrangements of tuning holes. Accordingly, the present invention is not limited to the 3×3 hole pattern shown in FIGS. 2A to 2D, 3A, 3B, 4A, and 4B.

The general requirement for couplings to be adjusted is that the aperture be close to the edge of a bonding face, such as Face 1 or Face 4, and that a tuning hole be placed close to that aperture. The general requirement for resonant frequencies to be tuned depends on the mode concerned, as has been seen above, and will be further discussed below.

A filled hole placed somewhere in the middle of a face will cause the mode with electric field striking that face (Z-mode in the case of holes on Face 6) to decrease in resonant frequency, as illustrated by E in column 7 of Table 2. An unfilled hole in a similar location will cause the same mode frequency to increase, as illustrated by E in column 4 of Table 2.

A filled hole placed in the current stream due to a particular mode will cause the resonant frequency of that mode to increase. This is illustrated by B, E and H in column 5 of Table 2 for the X-mode. These holes run across the face in the X-direction, and are located in the center in the Y-direction as can be seen in FIGS. 2C and 2D. This is the location of the X-mode current stream.

An unfilled hole placed in the current stream will have a negligible effect on the resonant frequencies of modes having minimal electric field in the location of the hole, such as the X-mode and Y-mode on Face 6. This is illustrated by the tiny resonant frequency shifts of the X-mode and Y-mode in columns 2 and 3 of Table 2.

To further illustrate the variation of resonant frequency shifts as the position of a hole is changed, plots showing these variations are shown below. They are based on calculations performed for a 17.9 mm×18.0 mm×18.1 mm cuboid with a dielectric constant of 45. The size of the hole was 1.0 mm in diameter and 1.0 mm deep.

Figure 5A:
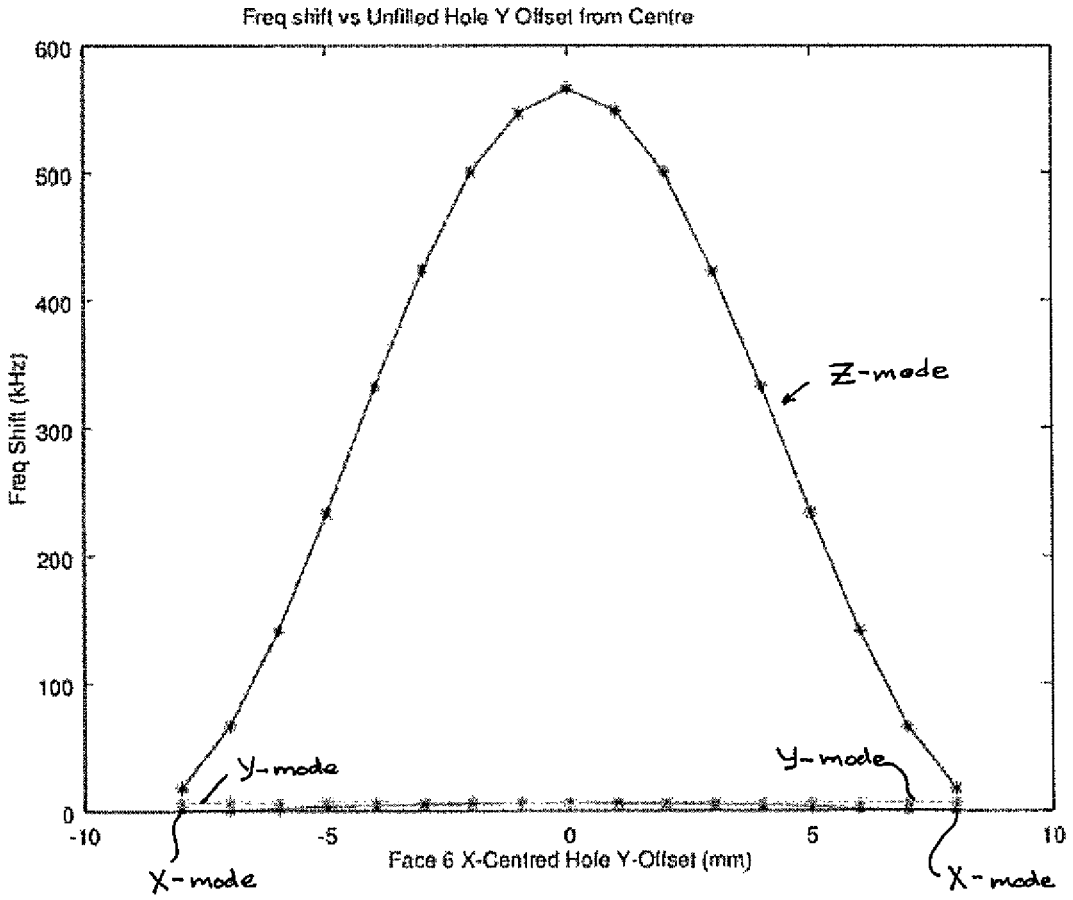
FIG. 5A is a plot of the resonant frequency shifts for the X-mode, the Y-mode, and the Z-mode as a function of the offset of an unfilled hole from the center of Face 6 in the Y-direction.
Figure 5B:
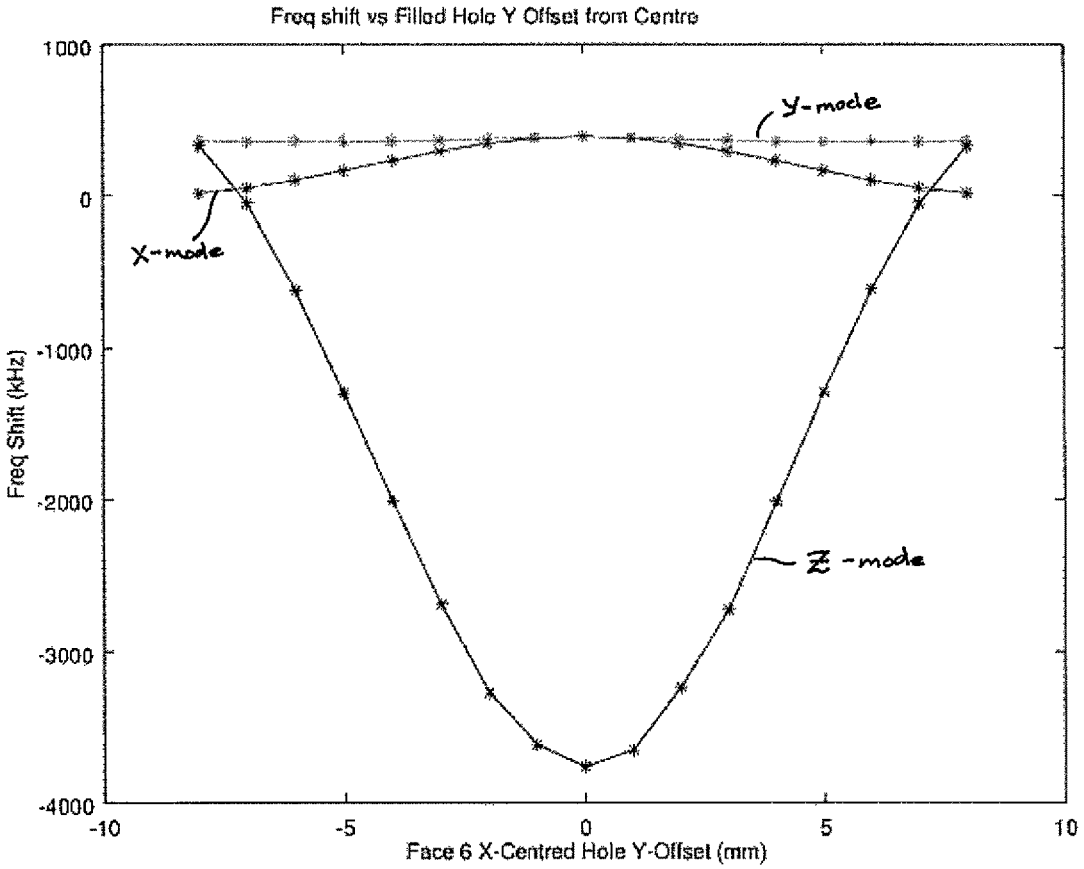
FIG. 5B is a plot of the resonant frequency shifts for the X-mode, the Y-mode, and the Z-mode as a function of the offset of a filled hole from the center of Face 6 in the Y-direction.

FIG. 5A shows the resonant frequency shifts for the X-mode, the Y-mode, and the Z-mode as a function of the offset of an unfilled hole from the center of Face 6 in the Y-direction, and FIG. 5B shows the resonant frequency shifts for the X-mode, the Y-mode, and the Z-mode as a function of the offset of a filled hole from the center of Face 6 in the Y-direction. Thus, the positions of the hole vary from positions D, E, and F in FIGS. 2C and 2D. The X-mode, Y-mode, and Z-mode resonant frequency shifts are as labelled in the plots. It is clear that the resonant frequency shift due to an unfilled hole, as shown in FIG. 5A, is almost entirely in the Z-mode. It should also be noted that the resonant frequency shift is greatest for a hole close to the center of the face (Face 6), where the electric field of the Z-mode is a maximum. The resonant frequency shift due to a filled hole, as shown in FIG. 5B, is mostly in the Z-mode, although significant shifts still occur for the X-mode and Y-mode. The resonant frequency shift of the Z-mode is greatest for a hole close to the center of the face where the electric field of the Z-mode is a maximum. It should be noted that the Y-mode shift is largely independent of the offset in the Y-direction. This is because the hole remains in the middle of the current stream of the Y-mode due to the stream flowing in the Y-direction. By way of contrast, the resonant frequency shift of the X-mode is a maximum in the center. This is because a displacement in the Y-direction moves the hole across the current stream of the X-mode. The variation of resonant frequency shift with offset is similar when the offset is in the X-direction except that the shifts of the X-mode and Y-mode are swapped.

Figure 6A:
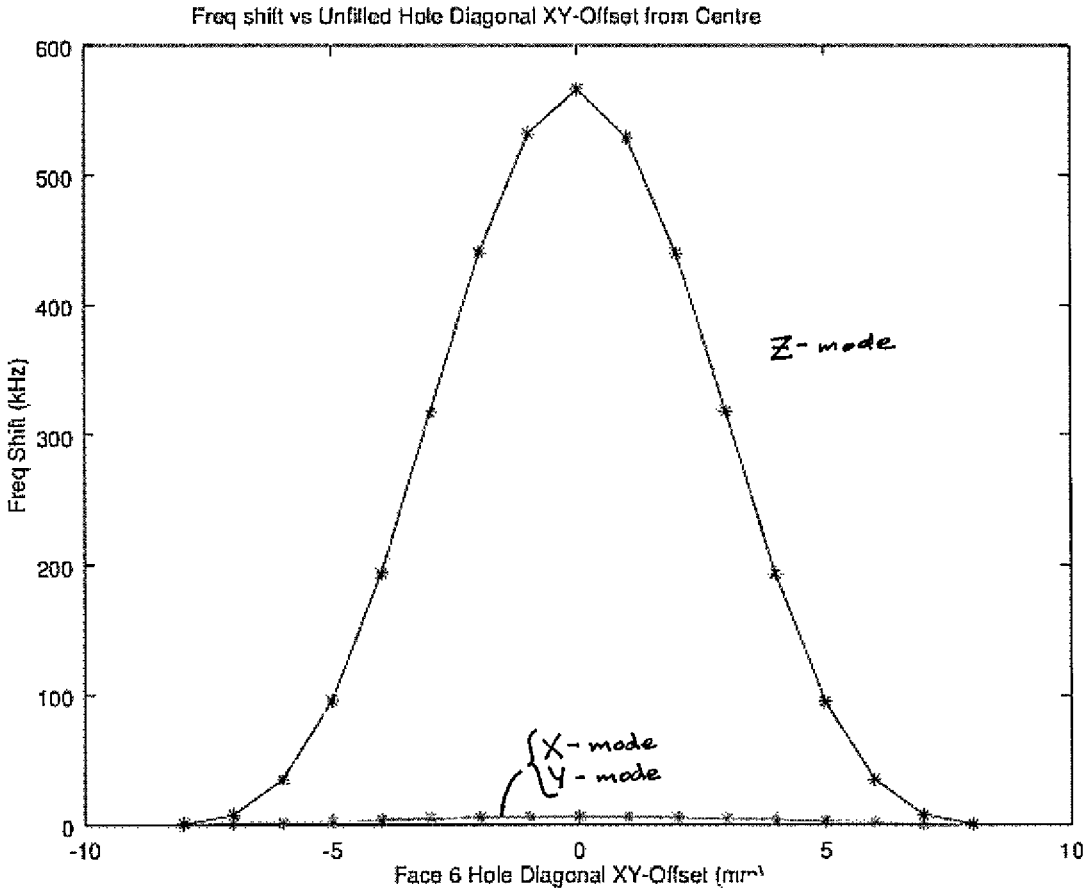
FIG. 6A is a plot of the resonant frequency shifts for the X-mode, the Y-mode, and the Z-mode as a function of the offset of an unfilled hole from the center of Face 6 in a 45-degree diagonal direction.
Figure 6B:
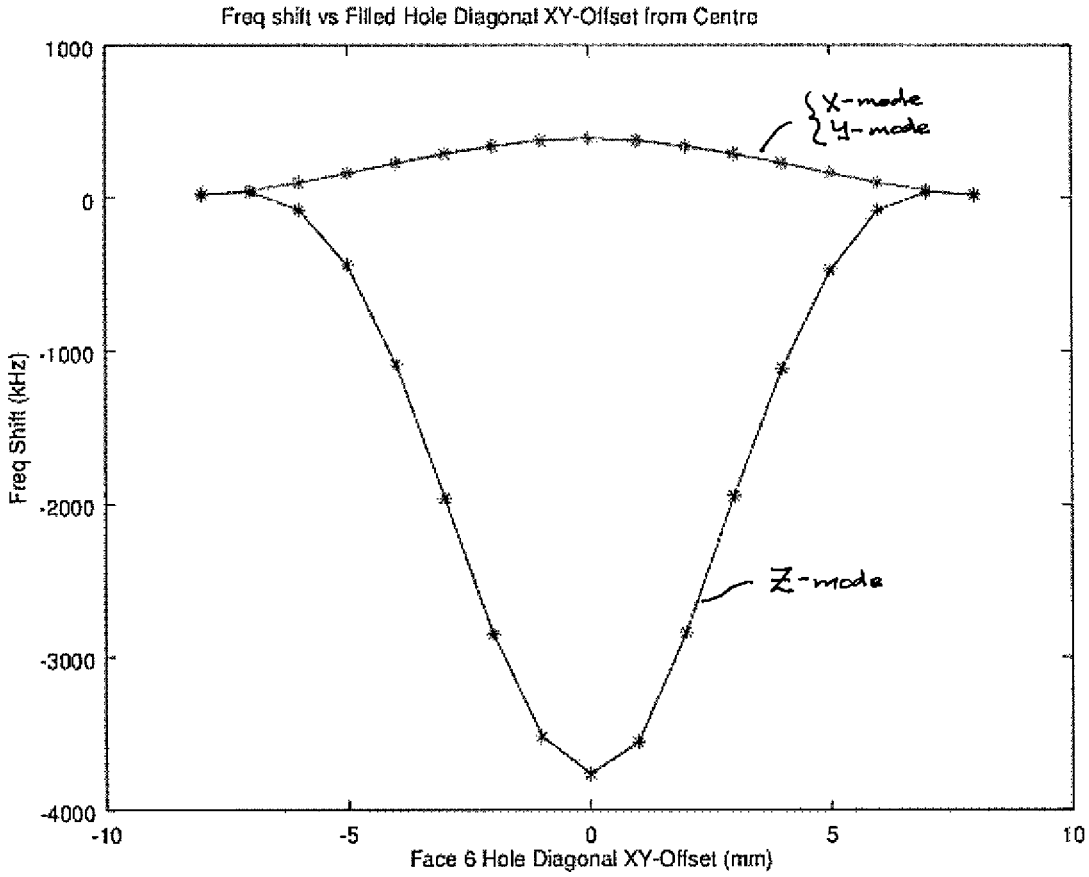
FIG. 6B is a plot of the resonant frequency shifts for the X-mode, the Y-mode, and the Z-mode as a function of the offset of a filled hole from the center of Face 6 in a 45-degree diagonal direction.

FIG. 6A shows the resonant frequency shifts for the X-mode, the Y-mode, and the Z-mode as a function of the offset of an unfilled hole from the center of Face 6 in a 45-degree diagonal direction, and FIG. 6B shows the resonant frequency shifts for the X-mode, the Y-mode, and the Z-mode as a function of the offset of a filled hole from the center of Face 6 in a 45-degree diagonal direction. Thus, the hole positions vary from positions A, E, and I in FIGS. 2C and 2D. The X-mode, Y-mode, and Z-mode resonant frequency shifts are as labelled in the plots. It is clear that the resonant frequency shift due to an unfilled hole, as shown in FIG. 6A, is almost entirely in the Z-mode. It should also be noted that the resonant frequency shift is greatest for a hole close to the center of the face (Face 6), where the electric field of the Z-mode is a maximum. The resonant frequency shift due to a filled hole, as shown in FIG. 6B, is mostly in the Z-mode, although significant shifts still occur for the X-mode and the Y-mode. The resonant frequency shift of the Z-mode is greatest for a hole close to the center of the face, where the electric field of the Z-mode is a maximum. The resonant frequency shifts of the X-mode and Y-mode are also greatest for a hole close to the center because this places the hole in the X-mode and Y-mode current streams.

In order to achieve a given resonant frequency shift, one may choose a certain combination of hole diameter and depth. A larger diameter hole will not need to be as deep as a smaller diameter hole in order to produce the same resonant frequency shift. This gives some freedom in choosing the drill diameter.

The available resonant frequency shifts from the present method are not very large compared with the shifts which are possible with lap tuning, such as are described in the above-referenced U.S. patent application Ser. No. 15/227, 169, however they are still large enough to be useful when the filter is close to tuned at the time of bonding.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted herein that while the above describes example embodiments of the invention, these descriptions should not be viewed in a limiting sense. Rather, there are several variations and modifications which may be made without departing from the scope of the present invention as defined in the appended claims.

What is claimed is:

1. A pair of joined dielectric resonator components of an RF filter, said pair of joined dielectric resonator components comprising:

a first dielectric resonator component including a first block of dielectric material, said first block of dielectric material having a coating of a first conductive material, said first dielectric resonator component being a slab-shaped cuboid having one dimension with a magnitude less than substantially equal magnitudes of two other dimensions; and a second dielectric resonator component including a second block of dielectric material, said second block of dielectric material having a coating of a second conductive material, said second dielectric resonator component being a generally cube-shaped cuboid with three dimensions of substantially equal magnitude, said first dielectric resonator component being joined to said second dielectric resonator component by bonding a first face of said first dielectric resonator component, said first face having dimensions of substantially equal magnitude, to a second face of said second dielectric resonator component, so that said one dimension of said first dielectric resonator component having a magnitude less than the substantially equal magnitudes of two other dimensions is perpendicular to said first and second faces, said first face having a first coupling aperture formed by removing a portion of said coating of first conductive material from said first block of dielectric material, and said second face having a second coupling aperture formed by removing a portion of said coating of second conductive material from said second block of dielectric material, said first coupling aperture and said second coupling aperture being aligned with one another when said first face is bonded to said second face, said first dielectric resonator component and said second dielectric resonator component thereby forming a linear stack having two end faces and four side faces, said linear stack thereby being oriented in a direction in common with the one dimension of said first dielectric resonator component having a magnitude less than substantially equal magnitudes of the other two other dimensions, wherein a first hole is provided at a point along a center line of a side face of said first dielectric resonator component in the direction of orientation of the linear stack, and a second hole is provided substantially in the center of a side face of said second dielectric resonator component to tune a resonant frequency of said pair of joined dielectric resonator components, and wherein at least one of the following applies:

said first hole and said second hole are on the same side face of said linear stack;

said first hole is capped with a metal cover; and said second hole is capped with a metal cover.

2. The pair of joined dielectric resonator components as claimed in claim 1, wherein said first hole is lined with a coating of a conductive material making electrical contact with said coating of first conductive material.

3. The pair of joined dielectric resonator components as claimed in claim 1, wherein said second hole is lined with a coating of a conductive material making electrical contact with said coating of second conductive material.

4. A pair of joined dielectric resonator components of an RF filter, said pair of joined dielectric resonator components comprising:

a first dielectric resonator component including a first block of dielectric material, said first block of dielectric material having a coating of a first conductive material, said first dielectric resonator component being a slab-shaped cuboid having one dimension with a magnitude less than substantially equal magnitudes of two other dimensions; and a second dielectric resonator component including a second block of dielectric material, said second block of dielectric material having a coating of a second conductive material, said second dielectric resonator component being a generally cube-shaped cuboid with three dimensions of substantially equal magnitude, said first dielectric resonator component being joined to said second dielectric resonator component by bonding a first face of said first dielectric resonator component, said first face having dimensions of substantially equal magnitude, to a second face of said second dielectric resonator component, so that said one dimension of said first dielectric resonator component having a magnitude less than the substantially equal magnitudes of two other dimensions is perpendicular to said first and second faces, said first face having a first coupling aperture formed by removing a portion of said coating of first conductive material from said first block of dielectric material, and said second face having a second coupling aperture formed by removing a portion of said coating of second conductive material from said second block of dielectric material, said first coupling aperture and said second coupling aperture being aligned with one another when said first face is bonded to said second face, said first dielectric resonator component and said second dielectric resonator component thereby forming a linear stack having two end faces and four side faces, said linear stack thereby being oriented in a direction in common with the one dimension of said first dielectric resonator component having a magnitude less than substantially equal magnitudes of two other dimensions, wherein a first hole is provided at a point along a center line of a side face of said first dielectric resonator component in the direction of orientation of the linear stack, and a second hole is provided substantially in the center of a side face of said second dielectric resonator component to tune a resonant frequency of said pair of joined dielectric resonator components, wherein a third hole is provided on a side face of said second dielectric resonator component, said third hole being adjacent to said second face and substantially midway between corners of said side face, to tune a second resonant frequency of said second dielectric resonator component.

5. The pair of joined dielectric resonator components as claimed in claim 4, wherein said second hole and said third hole are on the same side face of said linear stack.

6. The pair of joined dielectric resonator components as claimed in claim 4, wherein said third hole is capped with a metal cover.

7. The pair of joined dielectric resonator components as claimed in claim 4, wherein said third hole is lined with a coating of a conductive material making electrical contact with said coating of second conductive material.

8. A pair of joined dielectric resonator components of an RF filter, said pair of joined dielectric resonator components comprising:

a first dielectric resonator component including a first block of dielectric material, said first block of dielectric material having a coating of a first conductive material, said first dielectric resonator component being a slab-shaped cuboid having one dimension with a magnitude less than substantially equal magnitudes of two other dimensions; and a second dielectric resonator component including a second block of dielectric material, said second block of dielectric material having a coating of a second conductive material, said second dielectric resonator component being a generally cube-shaped cuboid with three dimensions of substantially equal magnitude, said first dielectric resonator component being joined to said second dielectric resonator component by bonding a first face of said first dielectric resonator component, said first face having dimensions of substantially equal magnitude, to a second face of said second dielectric resonator component, so that said one dimension of said first dielectric resonator component having a magnitude less than the substantially equal magnitudes of two other dimensions is perpendicular to said first and second faces, said first face having a first coupling aperture formed by removing a portion of said coating of first conductive material from said first block of dielectric material, and said second face having a second coupling aperture formed by removing a portion of said coating of second conductive material from said second block of dielectric material, said first coupling aperture and said second coupling aperture being aligned with one another when said first face is bonded to said second face, said first dielectric resonator component and said second dielectric resonator component thereby forming a linear stack having two end faces and four side faces, said linear stack thereby being oriented in a direction in common with the one dimension of said first dielectric resonator component having a magnitude less than substantially equal magnitudes of two other dimensions, wherein a first hole is provided at a point along a center line of a side face of said first dielectric resonator component in the direction of orientation of the linear stack, and a second hole is provided substantially in the center of a side face of said second dielectric resonator component to tune a resonant frequency of said pair of joined dielectric resonator components, wherein a fourth hole is provided on a side face of said second dielectric resonator component, said fourth hole being adjacent to a side edge of said side face and substantially midway between corners of said side face, to tune a third resonant frequency of said second dielectric resonator component.

9. The pair of joined dielectric resonator components as claimed in claim 8, wherein said second hole and said fourth hole are on the same side face of said linear stack.

10. The pair of joined dielectric resonator components as claimed in claim 8, wherein said fourth hole is capped with a metal cover.

11. The pair of joined dielectric resonator components as claimed in claim 8, wherein said fourth hole is lined with a coating of a conductive material making electrical contact with said coating of second conductive material.

12. A pair of joined dielectric resonator components of an RF filter, said pair of joined dielectric resonator components comprising:

a first dielectric resonator component including a first block of dielectric material, said first block of dielectric material having a coating of a first conductive material, said first dielectric resonator component being a slab-shaped cuboid having one dimension with a magnitude less than substantially equal magnitudes of two other dimensions; and a second dielectric resonator component including a second block of dielectric material, said second block of dielectric material having a coating of a second conductive material, said second dielectric resonator component being a generally cube-shaped cuboid with three dimensions of substantially equal magnitude, said first dielectric resonator component being joined to said second dielectric resonator component by bonding a first face of said first dielectric resonator component, said first face having dimensions of substantially equal magnitude, to a second face of said second dielectric resonator component, so that said one dimension of said first dielectric resonator component having a magnitude less than the substantially equal magnitudes of two other dimensions is perpendicular to said first and second faces, said first face having a first coupling aperture formed by removing a portion of said coating of first conductive material from said first block of dielectric material, and said second face having a second coupling aperture formed by removing a portion of said coating of second conductive material from said second block of dielectric material, said first coupling aperture and said second coupling aperture being aligned with one another when said first face is bonded to said second face, said first dielectric resonator component and said second dielectric resonator component thereby forming a linear stack having two end faces and four side faces, said linear stack thereby being oriented in a direction in common with the one dimension of said first dielectric resonator component having a magnitude less than substantially equal magnitudes of two other dimensions, wherein a first hole is provided at a point along a center line of a side face of said first dielectric resonator component in the direction of orientation of the linear stack, and a second hole is provided substantially in the center of a side face of said second dielectric resonator component to tune a resonant frequency of said pair of joined dielectric resonator components, wherein said first coupling aperture is adjacent to a corner of said first face, and said second coupling aperture is adjacent to a corner of said second face.

13. The pair of joined dielectric resonator components as claimed in claim 12, wherein a fifth hole is provided on a side face of said first dielectric resonator component, said fifth hole being adjacent to a corner of said side face and adjacent to the corner of said first face adjacent to said first coupling aperture, to adjust the coupling of said pair of joined dielectric resonator components.

14. The pair of joined dielectric resonator components as claimed in claim 13, wherein said first hole and said fifth hole are on the same side face of said linear stack.

15. The pair of joined dielectric resonator components as claimed in claim 13, wherein said fifth hole is capped with a metal cover.

16. The pair of joined dielectric resonator components as claimed in claim 13, wherein said fifth hole is lined with a coating of a conductive material making electrical contact with said coating of first conductive material.

17. The pair of joined dielectric resonator components as claimed in claim 12, wherein a sixth hole is provided on a side face of said second dielectric resonator component, said sixth hole being adjacent to a corner of said side face and adjacent to the corner of said second face adjacent to said second coupling aperture, to adjust the coupling of said pair of joined dielectric resonator components.

18. The pair of joined dielectric resonator components as claimed in claim 17, wherein said second hole and said sixth hole are on the same side face of said linear stack.

19. The pair of joined dielectric resonator components as claimed in claim 17, wherein said sixth hole is capped with a metal cover.

20. The pair of joined dielectric resonator components as claimed in claim 17, wherein said sixth hole is lined with a coating of a conductive material making electrical contact with said coating of second conductive material.

* * * * *